United States Patent [19]

Savard et al.

[11] Patent Number: 4,557,329

[45] Date of Patent: Dec. 10, 1985

[54] OIL RECOVERY BY IN-SITU COMBUSTION

[75] Inventors: Guy Savard, Westmount; Robert G. H. Lee, Montreal, both of Canada

[73] Assignee: Canadian Liquid Air Ltd./Air Liquide Canada LTEE, Montreal, Canada

[21] Appl. No.: 417,996

[22] Filed: Sep. 14, 1982

[30] Foreign Application Priority Data

Sep. 18, 1981 [CA] Canada ..... 386166

[51] Int. Cl.[4] ..... E21B 43/243

[52] U.S. Cl. ..... 166/261; 166/245; 166/242

[58] Field of Search ..... 166/261, 256, 260, 245

[56] References Cited

U.S. PATENT DOCUMENTS

| | | | |
|---|---|---|---|
| 2,994,375 | 8/1961 | Hurley | 166/261 X |
| 2,994,376 | 8/1961 | Crawford et al. | 166/256 X |
| 2,994,377 | 8/1961 | Trantham | 166/260 X |
| 2,999,539 | 9/1961 | Walls | 166/261 X |
| 3,007,520 | 11/1961 | Frey | 166/260 |
| 3,150,715 | 9/1964 | Dietz | 166/261 |
| 3,171,479 | 3/1965 | Parrish et al. | 166/261 |
| 3,208,519 | 9/1965 | Moore | 166/261 |
| 3,272,261 | 9/1966 | Morse | 166/261 X |
| 3,438,437 | 4/1969 | Christofferson | 166/57 |
| 3,441,083 | 4/1969 | Fitzgerald | 166/245 |
| 4,099,567 | 7/1978 | Terry | 166/261 |
| 4,252,191 | 2/1981 | Pusch et al. | 166/261 |
| 4,418,751 | 12/1983 | Emery | 166/261 |

FOREIGN PATENT DOCUMENTS

| | | | |
|---|---|---|---|
| 739768 | 8/1966 | Canada . | |
| 1034485 | 7/1978 | Canada | 166/261 |
| 1473669 | 2/1967 | France . | |

OTHER PUBLICATIONS

Jenkins et al., "Twenty Years Operation of an in situ Combustion Project", Petroleum Society of C.I.M., Jun. 16, 1978, 12 pages.

*Primary Examiner*—Stephen J. Novosad
*Attorney, Agent, or Firm*—Browdy and Neimark

[57] ABSTRACT

Enhanced recovery of oil from subterranean sedimentary formations by an in-situ combustion method employing a pattern of an injection well and several production wells, spaced-apart by a treatment zone. Combustion is controlled by placing at least one fluid conduit in a treatment zone and introducing a control fluid through it to modify the flame front. Oxygen may be introduced to take over from combustion air initially introduced through the injection well, to sustain combustion and advance the flame front. Water may be injected through the injection well, alternating with the oxygen through the control conduit to continue a wet combustion method started with air. The strategic placing of control conduits and the introduction of appropriate fluids may be employed to improve the sweep geometry by advancing the flame front or retarding it, or invading areas behind it. Safety means is provided for introducing the oxygen at a velocity greater than the maximum flame velocity encountered in the flame front.

16 Claims, 5 Drawing Figures

OIL RECOVERY BY IN-SITU COMBUSTION

BACKGROUND OF THE INVENTION (1) Field of the Invention

This invention relates to the recovery of oil from reservoirs in subterranean sedimentary formations by in-situ combustion, also referred to as "fire flooding".

(2) Description of the Prior Art

In-situ combustion methods for the recovery of oil from subterranean formations are disclosed in the following published texts, which are hereby incorporated by reference. "The Petroleum Reservoir" a Short Course by Selley, Anstey and Donohue, International Human Resources Development Corporation, Boston, Mass., 1981. The textbook "Enhanced Recovery of Residual and Heavy Oils", 2nd Ed. edited by M. M. Schumacher and published by Noyes Data Corporation, Parkridge, N.J., U.S.A., 1980. "Heavy Oil Recovery by in In-Situ Combustion" by Dr. Phillip D. White, Tejas Petroleum Engineers Inc., Dallas, Tex., a paper presented at a Dallas Section S.P.E., Continuing Education Seminar, Spring 1980. "Twenty Years Operation of an In-Situ Combustion Project" by Jenkins and Kirkpatrick, Petroleum Society of C.I.M., 1978. An article entitled "In-Situ Combustion Process—Results of a Five-Well Field Experiment, Southern Oklahoma" by Moss, White and McNeil, Magnolia Petroleum Company, Dallas, Society of Petroleum Engineers of AIME presented at the 33rd Annual Fall Meeting of the Society, Houston, Oct. 5–8, 1958.

The White paper points out that as late as 1979, in-situ combustion projects accounted for only a small proportion of the oil produced by thermal methods. It concludes that one deterrent is that the combustion process requires a much more intense engineering effort than other processes. There is a critical need for well designed equipment for control of the wells, rapid and accurate data accumulation, rapid data analysis and trained field operators. The paper states that only widespread field application of this process can supply these improvements.

Process control is essential and complex. To follow the progress of the burning front and to anticipate operating problems, basic data must be obtained and analyzed including air rate and pressure, water injection rate, gas vent rate in individual wells, casing pressures on production wells, gas analysis, oil and water production rate, temperature measurements. Other data which must be obtained on an infrequent, but regular basis includes oil gravity from each well, oil viscosity from each well, water analysis for chlorine, pH of water, pressure of fall-off tests of injectors. The first group of data allow calculations to be made on frontal movement, combustion efficiency and oxygen utilization. The second set of data allows corrections to be made to the calculated data and to prepare for heat front arrival at a producing well.

SUMMARY OF THE INVENTION

Having regard to what has been said, it is an aim of the present invention to provide an improved method of in-situ combustion for recovery of oil from subterranean formations.

In a method according to the invention, the in-situ combustion is controlled by the strategic placing of a fluid conduit or conduits, extending from the surface through the overburden to the treatment zone, at a position spaced from the injection well and control fluid introduced through the conduit into the reservoir independently of fluid injected through the injection well. In a preferred aspect of the invention, molecular oxygen is introduced as the control fluid, to take over as the combustion supporting gas and replace the flow of air through the injection well. In this case, the fluid conduit is in proximity to the injection well, but spaced from it by a minor separation zone to allow for separate control equipment at the surface. In the case of a wet combustion process, oxygen and water may be introduced alternately, the oxygen through the fluid conduit and the water through the injection well.

In another application, when monitoring of the flame front, propagated by air from the injection well, detects a cold zone in which the flame front is moving too slowly, for example, to interfere with the geometry of the well pattern and the efficiency of the sweep, a fluid control conduit is placed in that zone and oxygen introduced to accelerate the flame front and improve the sweep geometry. Or, if monitoring shows that the flame front is advancing too rapidly in a particular zone a control conduit may be introduced in that zone and appropriate fluids introduced to slow down the flame front and improve the sweep geometry.

The invention is preferably employed, in conjunction with a conventional in-situ combustion pattern, in which there is introduced through an injection well, extending from the surface through the overburden into the oil reservoir in an injection zone, air and water, under conditions to burn a portion of the oil and to cause the oil to flow through a treatment zone towards at least one production well, spaced from the injection well, preferably a multi-spot pattern. In accordance with the invention, an oxygen introduction conduit is strategically placed to extend from the surface through the overburden into the oil reservoir, within the treatment zone. In one embodiment of the invention, the oxygen conduit is placed in proximity to the injection well, but far enough removed from it that the oxygen control equipment at the surface is separated from the relatively complex control equipment at the injection wellhead. For example, in a multi-spot hexagonal pattern, in which the injection well is separated by a matter of about 400 feet from several, from say 6, production wells, the separate oxygen conduit may be spaced about 10 to 15 feet from the injection well.

In this embodiment, in a typical treatment cycle, air and water are introduced alternatively through the injection well to advance the flame front to a certain point. The air is then discontinued and, thereafter, the injection well is used to introduce substantially only water. In place of air, molecular oxygen is introduced into the reservoir by means of the oxygen conduit to continue the advance of the flame front.

The invention also contemplates a pattern for recovering oil from a subterraneous sedimentary formation by the wet combustion method in which there is an injection well equipped for introducing air or water or both under conditions to burn a portion of the oil with the air and a plurality of production wells spaced from the injection well towards which the oil is caused to flow through a treatment zone. A separate oxygen conduit extends from the surface through the overburden into the treatment zone of the formation in a position spaced-apart from the injection well, but in relative proximity thereto. The injection well is equipped with the normal, relatively complex, control apparatus for water and air. Because of the separate oxygen conduit, the control system at the surface is considerably simplified for both the air injection well and the oxygen conduit.

BRIEF DESCRIPTION OF THE DRAWINGS

Having thus generally described the invention, it will be referred to in more detail by reference to the accompanying drawings, illustrating preferred embodiments of the invention, and in which.

DESCRIPTION OF THE PREFERRED EMBODIMENTS

Figure 1:
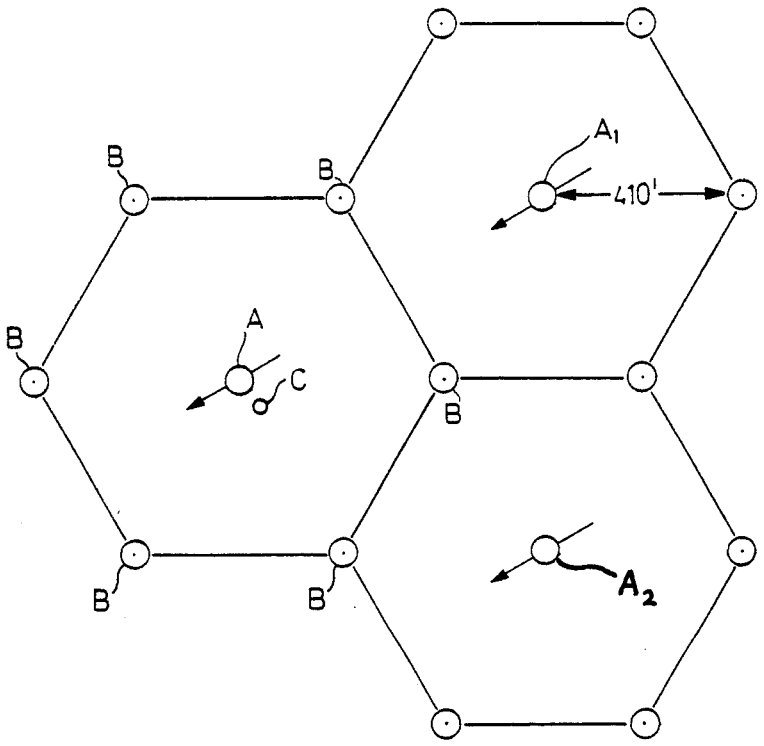
FIG. 1 is a top plan diagram illustrating a typical three pattern well configuration equipped according to the invention.

More particular reference will now be made to the drawings, first referring to FIG. 1. This figure shows a "three pattern" well configuration including three injection wells A, $A_1$ and $A_2$. Symmetrically arranged in spaced-apart relationship to the injection well A, for example, are a series of production wells B. Air is injected through the injection well A into the subterranean formation in an injection zone for combustion of the oil. The production wells B in the production zones are provided with pumping means so that when the combustion is started near the injection well A, the fluids including products of combustion water, steam and oil are drawn from the injection zone near the well A, through a treatment zone towards a production zone at the well B. A flame front is produced in the treatment zone between the injection and production zones.

In a typical conventional wet combustion operation a cycle is carried out in which air is introduced for two days, and water for one day, and the cycle repeated continually for a period of months or years. For example, the injection well A is located at the center of the pattern and the production wells B at the corners of the hexagon about 400 feet distance. The oil bearing formation may be several hundred feet to several thousand feet, say 2000 feet, from the surface. The thickness of the formation may run from a minimum of say one foot to over 100 feet. For example, most of the heavy oil found in the Lloydminister (Saskatchewan, Canada) area occurs in formations of about 20 feet thick. The operation may continue for months before any oil resulting from the fire flooding is recovered in the production wells.

In accordance with the invention, an oxygen conduit C extends from the surface through the overburden into the oil reservoir in the treatment zone spaced from the injection well A, but in relative proximity to it. For example, in the pattern, as shown, the oxygen conduit C might be 15 feet away from the injection well.

While the spacing is not critical, nevertheless, it is desirable that the oxygen conduit be located at a distance from the injection well so that the servicing of either may be effected independently. In all cases, a fluid must flow constantly through the oxygen conduit as well as through the injection well.

In accordance with the invention, after the flame front has advanced to the desired degree in the treatment zone, the injection of air and water through the injection well A is cut off and molecular oxygen introduced through the oxygen conduit alternating with the injection of water through the injection well.

In a typical starting up procedure, the pumps of the production well are started and a certain amount of oil will be withdrawn before fire flooding. Then, the flame can be ignited, for example, by putting a gas burner down the injection well and air or natural gas being supplied to support combustion. The burner can either remain in place or be retrieved depending on the circumstances.

Figure 2:
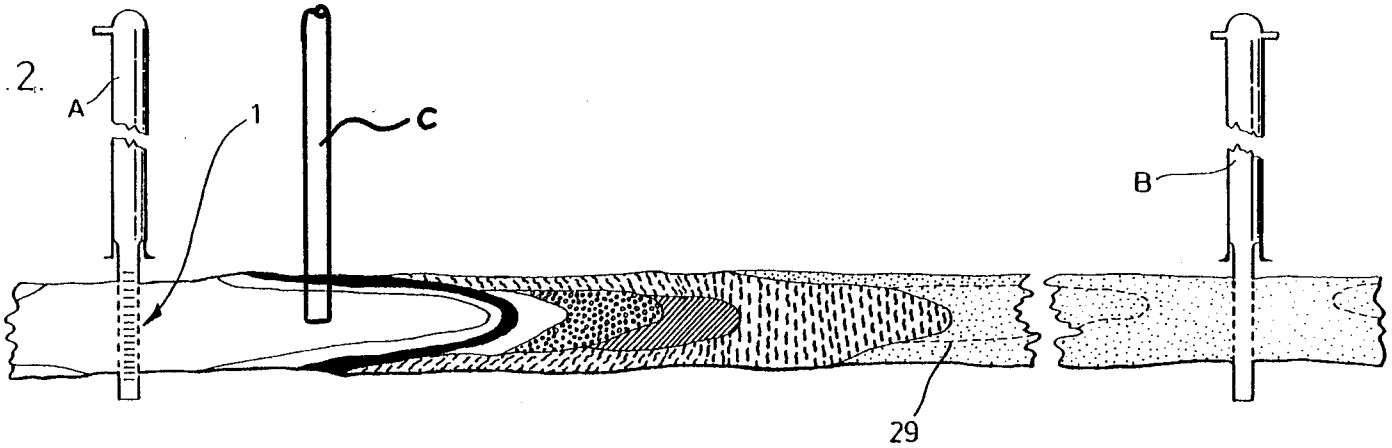
FIG. 2 is a diagrammatic vertical cross-section through a subterranean sedimentary formation on a larger scale.
Figure 3:
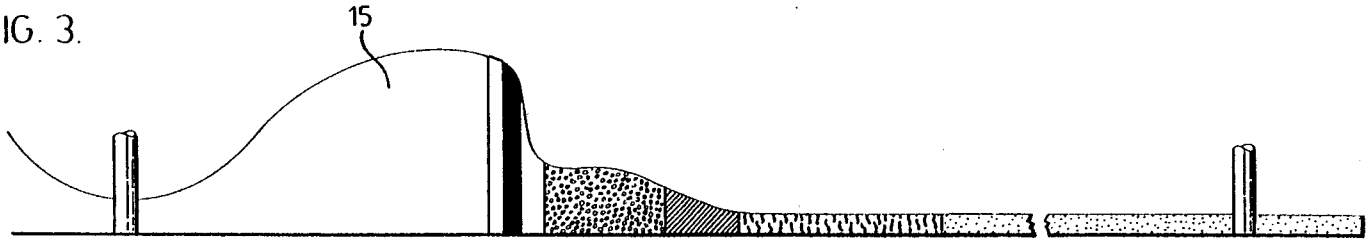
FIG. 3 is a diagrammatic showing of a typical temperature distribution curve through a formation invaded by a conventional in-situ combustion process on the scale of FIG. 2.

FIG. 2 is a conceptualized view of what happens in a wet combustion flame flooding operation. There is shown a cross-section through a sedimentary subterranean formation, containing oil, sometimes referred to as an oil reservoir, which has been invaded by wet combustion. The formation is made up of an injection zone surrounding the injector well A for introducing air to sustain combustion of oil in the reservoir and water to modify the heat transfer according to the wet combustion method, and a production zone surrounding the production well B for withdrawing fluids driven forward by the flame front. In between there is a treatment zone and the various materials making up this zone, at a particular stage in the operation, are indicated by legends on the drawings. In accordance with the invention, a gas injection tube C is strategically placed in the treatment zone to introduce oxygen to enhance the combustion or control the progress of the flame front as described in more detail herein. For example, once the flame front is advanced to a certain point, a shown in FIG. 2, an oxygen conduit can be placed to penetrate the burned region and oxygen introduced to support combustion, taking the place of the air injected through the well A. In the case of a wet combustion operation the oxygen introduction through the oxygen conduit may be alternated with water through the injection well. A typical procedure would be two days oxygen and one day water over the treatment period of possibly up to several years.

In a typical three-pattern well seven spot configuration shown, the injection well A is about 410 feet from the production well B. The treatment zone between the well A and the wells B, as shown in FIG. 1, covers about 10 acres. The depth of the sedimentary formation would run from one foot, up to 100 feet, it might be at a depth of 2000 feet more or less covered by an overburden in which there could be additional sedimentary oil-bearing formations separated by rock. The oxygen conduit C would be spaced about 10 to 15 feet from the injection well.

Construction

Figure 4:
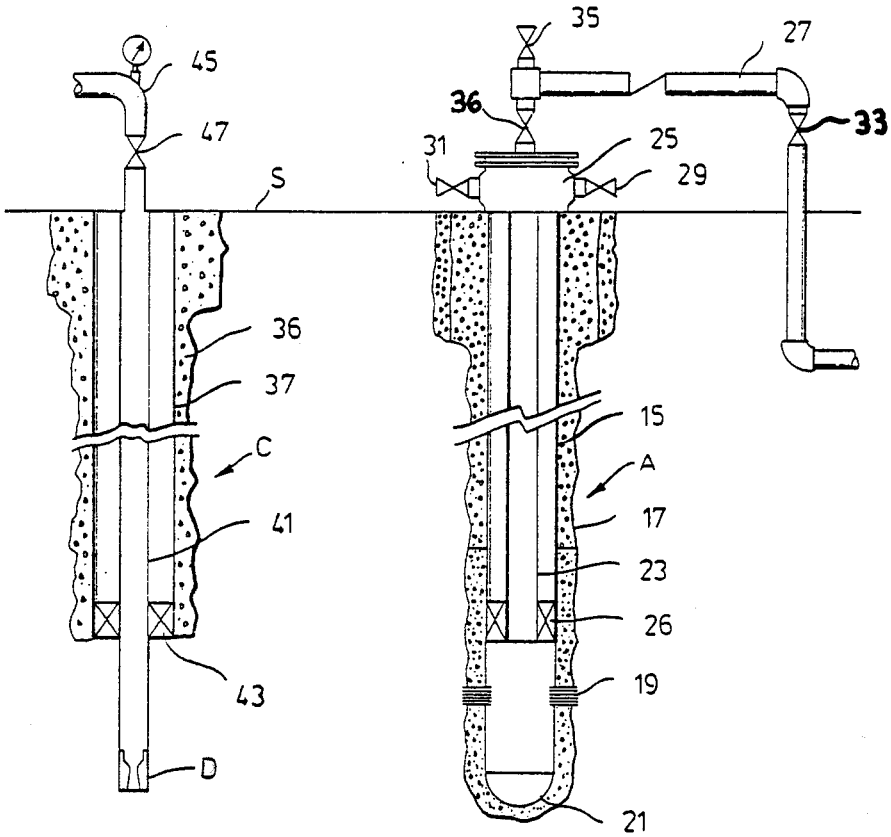
FIG. 4 is a diagrammatic vertical cross-section partly in elevation through a formation in which there is a wet combustion installation equipped according to the invention.

FIG. 4 shows an arrangement according to the invention in vertical cross-section through a subterranean formation. A typical air-water injection well is indicated generally by A. The well is made up of a wellbore lined with a steel casing 15 which extends from the surface S downward through the overburden into the subterranean sedimentary formation in which the oil reservoir is located. The bore, outside the casing 15, is appropriately filled with standard filling materials which form a shell 17 lining the bore. The shell 17 is provided with perforations 19 to allow fluids to flow out of the bore. The casing 15 is provided with a casing shoe 21. A lined tube 23 extends from a wellhead 25 on the surface to a retrievable packer 26 which centers its lower end in the shell 17. An air and water line 27 extends from an injection plant in which air or water may be supplied under pressure to the wellhead 25. Gate valves 29 and 31 are provided along with check valves 33 and full opening valves 35 and 36 in order to control the flow of air or water to the tubing 23. The apparatus at the top of the well A is often referred to, collectively, as a "Christmas Tree".

Spaced from the injection well A is an oxygen conduit C made up of a borehole accommodating a steel casing 37 and a concrete shell 36 filling the space between the borehole and the casing. Extending down within the borehole is an oxygen tube 41 which extends beyond the casing 37 through a retrievable packer 43 to project downward. The oxygen tube extends from the surface through the overburden into the subterranean sedimentary formation in the treatment zone between the injection well A and the production wells B. An oxygen supply line 45 runs from a source of oxygen under pressure through a full opening valve 47 to the oxygen conduit 41. Since oxygen only is introduced through the conduit C, the pipe 41 does not have to be made of the expensive stainless steel required for the injection well A where corrosion is encountered through the presence of water. Moreover, relatively simple control equipment for the oxygen is all that is necessary.

The lower end of the oxygen tube is provided with a safety injector D of which details will be given later.

Safety Injector

Figure 5:
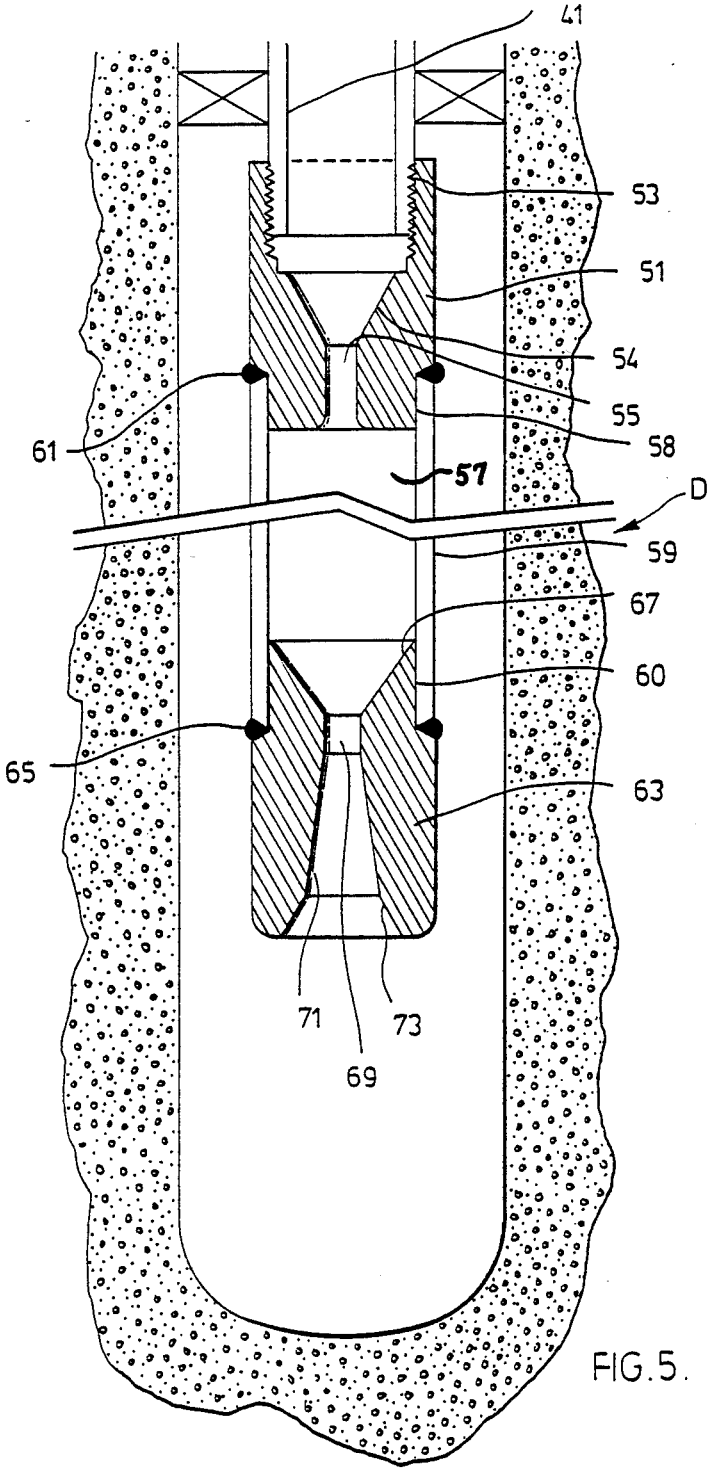
FIG. 5 is a vertical cross-section through a safety injector, according to the invention.

FIG. 5 is an enlarged fragmentary vertical crosssection through the bottom of the oxygen conduit. The end of the tube 41 is externally threaded to receive an overall cylindrical connector member 51. The member 51 has an internal bore having a tapped enlarged cylindrical part 53 threadably engaging the end of the pipe 41. The bore narrows in a frusto conical part 54 to a throat 55 defining the entrance to a central restricted cylindrical passage 57. The lower end of the member 51 has an annular recess 58 receiving the end of a nickel alloy pipe 59. The pipe 59 and the connector member 51 are welded together as at 61.

Mounted on the lower end of the pipe 59 is a tip member 63. The member 63 has an overall cylindrical body having an upper annular recess 60 receiving the end of the pipe 59. The member 63 and the pipe 59 are welded together as at 65. The body of the member 63 is provided with a central passage having an upper frusto conical portion 67 narrowing to a short cylindrical throat 69 and then widening to a frusto conical part 71 terminating in a wider shorter frusto conical part 73. The parts 51 and 63 are made of non-scarfing nickel alloy.

The size of the oxygen pipe is governed largely by the strength required to pull a packer. The smallest would be about 2 inches, the largest 10 inches with 7 inches a practical intermediate size. It has to be big enough to be able to feed cement through it. As far as its oxygen carrying function is concerned, a 2 inch diameter pipe is adequate. The maximum size would be a pipe which can be part of the well and still be grouted. To support combustion, the pressure will generally be the same as that of the air, and will run from 400 psig to 1000 psig. A rule of thumb calculation is a half pound pressure per foot of depth. The specific pressure will depend on the combination of the depth and the porosity of the formation. The drill holes could be any diameter. There will be a plunger to push out the grout. The oxygen will be supplied from a plant on the surface supplying oxygen at low pressure at a capacity of at least 18 tons a day and compressing it to 400 psig to 1000 psig. The oxygen conduit should be equipped for quick changeover to other fluids.

For safety reasons, at least part of the passage through which oxygen containing gas is introduced must be restricted to a size to ensure that the velocity of the gas flow rate is greater than the maximum flame velocity which can occur. This can be accomplished by employing an injector as described in FIG. 5. This injector has restricted throats in series followed by an outlet of increasing size to provide for expansion of the gas to slow its velocity and minimize the sandblasting effect within the casing.

The safety injector shown is applicable not only for molecular oxygen but also molecular oxygen in combination with another fluid with desirable properties for in-situ combustion of hydrocarbon deposit, for example, $CO_2$, $N_2$, air, $H_2O$ and the like.

The tube downhole of the packer must be resistent to scarfing in contact with oxygen, to heat, to corrosion and to erosion. Aside from these, the tube has to provide the maximum safety. In a hydrocarbon formation, for instance, it is always possible to have upset conditions whereby combustibles may seep into and around the injection tubing.

A hydrocarbon can burn with air resulting in a flame of a certain velocity. If this same hydrocarbon is burned with molecular oxygen, its flame velocity can be substantially increased. For example, methane-air produces a maximum flame velocity of 1.5 ft/sec, however, the methaneoxygen flame has a maximum velocity of 15 ft/sec. Hydrogenair has a maximum flame velocity of 10 ft/sec; however, the hydrogen-oxygen flame has a maximum velocity of 46 ft/sec. Since the hydrogen-oxygen flame has the highest maximum velocity of any of the possible species which may be encountered in the hydrocarbon formation during a fire flood it is imperative, from the safety point of view, to provide for the velocity of this flame.

Another factor to consider is the effect of pressures on the flame velocity. For example, at 300 psig pressure, the $H_2$—$O_2$ flame is about 65 ft/sec; at 900 psig pressure, the velocity is about 93 ft/sec; and at 1500 psig pressure, the velocity is 100 ft/sec.

A further consideration in the design of the bottom hole injection tubing is mechanical strength. To obtain the proper strength, the inside diameter of the tubing is generaly too large to permit the oxidizing gas to flow at a sufficiently high velocity to prevent flame from propagation back into the tubing. In this case, a nozzle can be placed at the outlet of the tubing to accelerate the oxidizing gas to above the maximum flame velocity to prevent propagation of the flame back into the tubing. To have further assurance, another nozzle or several nozzles can be placed upstream of the outlet nozzle to overcome any flame flashback.

Again, if the oxidizing gas flow rate through the tubing (with the proper mechanical strength) is sufficiently great so that its gas velocity is greater than the maximum expected flame velocity which can be encountered at the injection well, then the oxidizing gas accelerating nozzles are not required.

These nozzles can be straight bore or preferably a venturi type as, for example, shown in FIG. 5 which is designed for prevention of scarfing in contact with oxygen for minimizing mechanical strength and for prevention of flame flashback into the tubing.

Preferably, for example, monel is chosen for its resistance to burning in contact with oxygen gas. It is also relatively resistant to corrosion. The two inch, schedule 80 pipe size is for mechanical strength because it has a free length of 18 feet.

To avoid flashback a venturi type nozzle is placed at the outlet of the injector at the bottom. As a safety backup, another nozzle is placed upstream.

This injector is designed for example, 300,000 scf/day of oxygen flow at 450 psig and at ambient temperature. To ensure that flashback can be prevented by either of the two nozzles, the dimension of the throat of the venturi nozzle is about 0.45" diameter. This enables the oxidizing gas to have a velocity of 100 ft/sec, which is higher than any flame velocity which is to be encountered at the bottom of an injection well or oxygen conduit.

The outlet (or outlets) to the injector may consist of one or more holes. Each hole must be dimensioned to produce an injected oxidizing gas velocity greater than the maximum flame velocity to be encountered.

The bottom hole injector can be used only for the oxidizing gas or gas mixture or it can be used to alternate with water flood on an intermittent basis. For example, it can be used for the oxidizing gas and gas mixture with the other injected fluids (e.g. $H_2O$ and/or air) injected into the formation via another injection well. If this is the situation, then the $H_2O_2$ air or other fluids need not be hydrocarbon (e.g. oil) free. On the other hand, if all the fluids for the injection well are to be injected into the formation by only this one injector, then all the fluids must be oil-free, especially when the oxidizing gas is molecular oxygen.

Other Factors

A main feature of the present invention is the strategically oriented introduction of molecular oxygen in place of air as the combustion supporting gas, meaning oxygen of a concentration of 90% by volume (measured under standard conditions) or greater, and preferably of a concentration of at least 99.5%.

The use of a separate oxygen conduit, as compared with an injection well equipped for injecting air and water, makes feasible the selective introduction of oxygen without the prohibitive engineering and material costs of an injection well equipped for oxygen injection. For example, because of the presence of corrosive elements and compounds in the water, which, in the presence of oxygen, will tend to accelerate corrosive action, it is necessary to use materials in an injection well which will give adequate protection against corrosion. These materials could include, for example, stainless steels, inconel, monel, haystellite and others. Moreover, the presence of oil in the ejected air caused by the lubrication of the air compressor could, in the presence of oxygen, create an explosive hazard. Elimination of this problem would require special oil removal filters. Instrumentation required for safety reasons to control the flows of air and/or oxygen require a complex surface installation.

By using a separate conduit for the injection of oxygen these problems are avoided. Water does not flow through the oxygen conduit so it is completely dry and there is no need to use anti-corrosive materials. Therefore, cheaper steel tubing can be employed. Having regard to the relatively low cost of such an oxygen conduit several may be employed in successive locations as the fire front progresses. It may also be desirable, under certain conditions, to use a mixture of oxygen with various concentrations of air, nitrogen or carbon dioxide or other gases within one or several locations within the well pattern to produce special effects as described herein.

The theoretical aereal sweep efficiency, using molecular oxygen, would be about 45% to 50%, as compared with considerably less than this using air. This is because there is less ballast nitrogen, higher partial pressure of $CO_2$ from the oxygen combined with coke. There is more $CO_2$ in the oil, decreasing its viscosity, more flowthrough production, and less entrainment of nitrogen in the production well. The emulsion, at the production well, when air is used as the combustion supporting gas, is difficult to break. Using oxygen, the emulsion formed is easier to break. The product coming up the production well using air contains oil and sand, water, gas, $CO_2$ and nitrogen, some methane, some hydrogen and some sulphur. Using molecular oxygen there is very little nitrogen, higher $CO_2$, less sand, water and methane. A critical flow of air would be about 200,000 feet per well per day. With the same critical flow there is 5 times the oxygen, a higher production rate, less entrainment and a third more oil should be recovered.

The overall advantages of using oxygen, as opposed to air, in in-situ combustion, have been described in Canadian Pat. No. 770,434, Moore, Oct. 31, 1967, and U.S. Pat. No. 3,208,519, Moore, Sept. 28, 1965. These patents describe the advantages of using oxygen or gas containing down to 80% free oxygen. However, the present method should not be confused with that described in the Moore patents, which employ an injection well for both oxygen and water. In contrast, the applicant achieves the introduction of oxygen by employing a separate simple conduit in which oxygen may be delivered through a string of low cost pipe, for example of mild carbon steel. It need only be strong enough to withstand the forces of installation and its outlet end be appropriately fashioned to withstand the temperatures to which it may be exposed. Where, for example, the conduit is installed in advance of the flame front, the tube can be protected by water jacketting or thick grouting. There must always be fluid flow through the tube, as there has to be in the injection well, to prevent blowback into the conduit. The extreme flexibility of using a conduit of this type for the injection of oxygen will be understood from the foregoing description.

There are a number of patents describing variations in the in-situ process and involving the injection of other materials along with the air and/or water and it is not thought necessary to discuss these in detail since they are now known in the art and will not affect the overall application of the present method. Furthermore, it is understood that the showing of the well pattern is simplified. A three pattern well configuration has been shown but there could be any number of patterns in a field development plan. Further, the applicant has not shown observation wells as are often employed to survey the nature of the subterranean sedimentary formations. It is understood that the various means which are employed for this purpose and for monitoring the progress of the flame front may be used in conjunction with the invention.

The use of a separate oxygen conduit or conduits also permits great flexibility in the injection of oxygen into the formation, not only over the area of the treatment zone, but also at different levels. For example, conduits can lead to levels below which the water is injected into the injection well in a wet combustion operation. For example, the oxygen can be introduced near the bottom of the oil reservoir or at intermediate points. Where there is a tendency for the water to flow downwards and the oxygen upwards such an arrangement can provide improved cooperation between the oxygen introduced and the water injected in propagation and control of the flame front. With a simple conduit the level of the outlet can be more readily adjusted than with an expensive injection well.

Criteria for the relative amounts of oxygen and water to be injected at various stages of the in-situ combustion and under the various conditions brought about by it, have been established in the art. Generally speaking, the ratio of water to free oxygen must be below that at which the combustion will be extinguished. At the same time, enough water should be injected through the injection well to maintain water permeability of the heated portion of the reservoir behind the flame front and to reduce the temperature within that heated portion. The precise amounts for a given treatment will depend on various factors as discussed in the prior art.

We claim:

1. In an in-situ forward combustion method for the recovery of oil from a subterranean sedimentary formation constituting an oil reservoir, in which air is injected through an injection well extending from the surface through the overburden into the oil reservoir at an injection zone under conditions to create a flame front moving away from the injection well to burn a portion of said oil and to cause fluids including oil to flow forward through a treatment zone towards at least one production well equipped for withdrawing oil and gases spaced from the injection well, the improvement in which, air is introduced into the treatment zone through the injection well to advance the flame front to a certain point, then the injection of air is discontinued, and molecular oxygen is introduced directly into the treatment zone at a velocity greater than that of the flame front through a separate conduit specially equipped for the injection of molecular oxygen extending from the surface through the overburden into the oil reservoir in proximity to, but spaced from the injection well and between it and the production well to continue the advance of the flame front towards the production well.

2. An in-situ forward combustion method, as defined in claim 1, in which the oxygen is introduced through at least one restricted passage from the conduit to increase the velocity of its delivery into the treatment zone.

3. In an in-situ forward combustion method for the recovery of oil from a subterranean sedimentary formation constituting an oil reservoir, in which air is injected through an injection well extending from the surface through the overburden into the oil reservoir at an injection zone under conditions to create a flame front moving away from the injection well to burn a portion of said oil and to cause fluids including oil to flow forward through a treatment zone towards at least one production well equipped for withdrawal of oil and gases spaced from the injection well, the improvement in which, air and water are introduced through the injection well to advance the flame front to a certain point, then the introduction of air through the injection well is discontinued, and, molecular oxygen is introduced directly into the treatment zone at a velocity greater than that of the flame front through a separate conduit specially equipped for the injection of molecular oxygen extending from the surface through the overburden into the oil reservoir in proximity to, but spaced from the injection well and between it and the production well to advance the flame front towards the production well.

4. A method, as defined in claim 1 or 3, in which the progress of the flame front through the treatment zone is controlled by the positioning of additional oxygen conduits within the treatment zone and supplying oxygen through them at a velocity greater than that of the flame front to increase the volumetric sweep in the direction of the production well.

5. In an in-situ forward combustion method for the recovery of oil from a subterranean sedimentary formation in which there is introduced, through an injection well, a fluid selected from the group consisting of combustion-containing gas, water and a mixture of combustion-containing gas and water under conditions to create a flame front to burn a portion of the oil and to cause fluid, including oil to flow towards at least one production well spaced from the input well by a treatment zone, and equipped for withdrawing oil and gases, comprising, conveying molecular oxygen through a separate conduit specially equipped for injecting molecular oxygen separated from said injection well leading from the surface through the overburden to the formation whereby the molecular oxygen is introduced directly into the formation at a velocity greater than that of the flame front separately from the water to sustain combustion and continue the advance of the flame front towards the production well.

6. A method, as defined in claim 1, 3 or 5, in which the oxygen is injected from the separate oxygen conduit at a velocity greater than the maximum flame velocity encountered in close proximity to the oxygen conduit.

7. An in-situ forward combustion method for the recovery of oil from subterraneous sedimentary formations containing an oil reservoir, in which there is introduced through an injection well extending from the surface through the overburden into the oil reservoir, in an injection zone, air under conditions to burn a portion of the oil to form a flame front and to cause fluids including oil to flow outwards towards a plurality of production wells each equipped to withdraw oil and gases and spaced from the injection well to form a pattern and from which fluids are withdrawn, in which, combustion of the oil in the reservoir is initiated and continued by injecting air through the injection well to produce a flame front and to cause the flame front to advance towards the production wells through a part of the treatment zone, then, the injection of air is discontinued and molecular oxygen is introduced at a velocity greater than that of the flame front through at least one separate conduit extending from the surface through the overburden into the oil reservoir within the treatment zone in proximity to the injection well between it and the production wells and such injection of molecular oxygen is continued to cause the flame front to advance through a further part of the treatment zone.

8. In an in-situ combustion method for the recovery of oil, as defined in claim 7, in which water is introduced alternately to the air as the flame front advances through said part of the treatment zone, and then the injection of air through the injection well is discontinued and water is injected through the injection well alternately with the introduction of oxygen through the oxygen conduit.

9. An in-situ forward combustion method for the recovery of oil from a subterranean sedimentary formation constituting an oil reservoir, in which oxygen-containing gas and water are injected into an injection zone in the oil reservoir, under conditions to burn a portion of said oil to form a flame front and to cause said flame front and fluids including oil to flow through a treatment zone towards at least one production well equipped for withdrawal of oil and gases and spaced from the injection well, in which, the water is injected through an injection well and the oxygen-containing gas is molecular oxygen and is introduced at a velocity greater than that of the flame front through a conduit separated by part of said sedimentary formation from the injection well and extending from the surface through the overburden into the oil reservoir within the treatment zone.

10. A method, as defined in claim 9, in which the oxygen is introduced through the separate conduit at a level below that at which the water is injected through the injection well.

11. A method, as defined in claim 9, in which the oxygen is injected through several separate conduits at respectively different levels below the level at which the water is injected through the injection well.

12. An in-situ forward combustion method for the recovery of oil from a subterranean sedimentary formation containing an oil reservoir, in which air is injected through an injection well extending from the surface through the overburden into the oil reservoir in an injection zone under conditions to burn a portion of the oil to form a flame front and to cause fluids including oil to flow towards a plurality of production wells equipped for withdrawing oil and gases and forming with the injection well and from which fluids are withdrawn spaced from the injection well to form a pattern, in which, combustion of the oil in the reservoir is initiated and continued by injecting air through the injection well to produce the flame front and then air and water are injected through the injection well to cause the flame front to advance through a section of the treatment zone to the point where the aereal sweep of the flame front becomes distorted by drag of the flame front in a particular part of the treatment zone, the improvement in which, molecular oxygen is introduced at a velocity greater than that of the flame front through an oxygen conduit extending from the surface through the overburden into said particular part to cause advance of the flame front to improve the geometry of the flame front.

13. An in-situ forward combustion method for the recovery of oil from a subterranean sedimentary formation constituting an oil reservoir, in which there is introduced through an injection well extending from the surface through the overburden into the oil reservoir at an injection zone, air under conditions to burn a portion of said oil and to cause fluids including oil to flow through a treatment zone towards at least one production well equipped to withdraw oil and gases and spaced from the injection well, in which, combustion of oil in the reservoir is initiated and continued by injecting air through the injection well to produce a flame front and causing the flame front to advance through a section of the treatment zone towards the at least one production well, then, the air is discontinued and molecular oxygen is introduced at a velocity greater than that of the flame front through a separate conduit extending from the surface through the overburden into the oil reservoir within the treatment zone in proximity to the injection well, and such injection of molecular oxygen is continued to cause the flame front to advance through a further section of the treatment zone.

14. A forward combustion method for the recovery of oil, as defined in claim 13, in which water is introduced alternately to the air to cause the flame front to advance through the first section of the treatment zone, then, moleclar oxygen is introduced at a velocity greater than that of the flame front through a separate conduit extending from the surface through the overburden into the oil reservoir within the treatment zone in proximity to the injection well, and water is introduced through the injection well alternately with the oxygen through the oxygen conduit.

15. An installation for the in-situ recovery of oil from subterraneous sedimentary formations containing an oil reservoir, comprising, an injection well extending from the surface through the overburden into the oil reservoir in an injection zone and equipped for injecting air and water to create a flame front moving away from the injection well, a plurality of production wells each equipped to withdraw oil and gases in a production zone each spaced from the injection zone by a treatment zone, each of the production wells being equipped for withdrawing fluids from the formation, at least one fluid conduit extending from the surface through the overburden into the treatment zone at a position close to but spaced from the injection well and equipped for introducing molecular oxygen into the formation at a velocity greater than that of the flame front, to sustain the flame front.

16. An in-situ forward combustion method for the recovery of oil from a subterranean sedimentary formation constituting an oil reservoir, in which air is injected through an injection well extending from the surface through the overburden into the oil reservoir at an injection zone under conditions to create a flame front moving away from the injection well to burn a portion of said oil and to cause fluids including oil to flow forward through a treatment zone towards at least one production well equipped for withdrawal of oil and gases and spaced from the injection well, the improvement in which, a flame front is caused to advance towards the production well to a certain point in the treatment zone, then a separate conduit is introduced behind the flame front, after its passage, and molecular oxygen is introduced directly into the treatment zone at a velocity greater than that of the flame front through a separate injection conduit whereby the oxygen reaches the burned out zone, depleted in hydrocarbon, to support combustion of the coke thereby to provide an additional source of heat behind the flame front.

* * * * *